US009139937B2

(12) United States Patent
Blaszak et al.

(10) Patent No.: US 9,139,937 B2
(45) Date of Patent: Sep. 22, 2015

(54) METHOD OF STRENGTHENING EXISTING STRUCTURES USING STRENGTHENING FABRIC HAVING SLITTING ZONES

(71) Applicant: MILLIKEN & COMPANY, Spartanburg, SC (US)

(72) Inventors: Gregg J. Blaszak, Greenville, SC (US); Gregory A. Norton, Spartanburg, SC (US); Pradipkumar Bahukudumbi, Greenville, SC (US)

(73) Assignee: Milliken & Company, Spartanburg, SC (US)

( * ) Notice: Subject to any disclaimer, the term of this patent is extended or adjusted under 35 U.S.C. 154(b) by 104 days.

(21) Appl. No.: 14/036,725

(22) Filed: Sep. 25, 2013

(65) Prior Publication Data

US 2014/0144095 A1 May 29, 2014

Related U.S. Application Data

(60) Provisional application No. 61/730,540, filed on Nov. 28, 2012.

(51) Int. Cl.

| | |
|---|---|
| ***E04F 13/07*** | (2006.01) |
| ***E04F 13/072*** | (2006.01) |
| ***E04F 13/073*** | (2006.01) |
| ***E04F 13/075*** | (2006.01) |
| ***B29C 65/52*** | (2006.01) |
| ***B32B 37/12*** | (2006.01) |
| ***B32B 43/00*** | (2006.01) |
| ***D03D 13/00*** | (2006.01) |
| ***D03D 15/02*** | (2006.01) |
| ***E04G 23/02*** | (2006.01) |

(52) U.S. Cl.

CPC ..... *D03D 13/00* (2013.01); *D03D 13/006* (2013.01); *D03D 15/02* (2013.01); *E04G 23/0218* (2013.01); *D10B 2401/041* (2013.01); *D10B 2505/02* (2013.01); *E04G 2023/0251* (2013.01); *Y10T 442/3179* (2015.04)

(58) Field of Classification Search

CPC ..... D03D 13/00; D03D 13/006; D03D 15/02; E04G 23/0218; D10B 2401/041; D10B 2505/02; B29C 70/083; C08J 5/12; C08J 5/124; B29K 2021/003; C09J 5/02; B32B 2419/00

USPC ..... 156/71, 307.1, 307.3, 307.5, 307.7

See application file for complete search history.

(56) References Cited

U.S. PATENT DOCUMENTS 4,410,385 A * 10/1983 Murphy et al. ..... 156/181
4,698,276 A * 10/1987 Duval ..... 428/116

(Continued)

FOREIGN PATENT DOCUMENTS

GB 2295637 A * 6/1996

*Primary Examiner* — Sing P Chan
(74) *Attorney, Agent, or Firm* — Cheryl J. Brickey

(57) ABSTRACT

Disclosed is a method of strengthening existing structures containing the following steps. An existing structure made of concrete, steel, timber, masonry to be reinforced and a reinforcing sheet are provided, where the reinforcing sheet contains an alternating arrangement of reinforcement zones and slitting zones. The reinforcement zones contain unidirectional strengthening fibers in the warp direction of the reinforcement sheet and the slitting zones have an absence of strengthening fibers. The reinforcement sheet is slit through the slitting zones and the reinforcement zones are adhered to the existing structure.

14 Claims, 2 Drawing Sheets

(56) References Cited

U.S. PATENT DOCUMENTS

| | | | | |
|---|---|---|---|---|
| 4,819,395 | A | 4/1989 | Sugita et al. | 52/309.16 |
| 5,218,810 | A | 6/1993 | Isley, Jr. | 52/725 |
| 5,607,527 | A | 3/1997 | Isley, Jr. | 156/71 |
| 5,657,595 | A | 8/1997 | Fyfe et al. | 52/252 |
| 5,981,050 | A | 11/1999 | Kaempen et al. | 428/294.7 |
| 6,250,030 | B1 | 6/2001 | Sugimoto et al. | 52/223.1 |
| 6,277,771 | B1 | 8/2001 | Nishimura et al. | 442/229 |
| 6,363,681 | B1 * | 4/2002 | Neuner | 52/834 |
| 6,387,479 | B1 | 5/2002 | Hayashi et al. | 428/297.4 |
| 6,544,624 | B1 | 4/2003 | Lopez-Anido et al. | 428/118 |
| 6,591,567 | B2 | 7/2003 | Hota et al. | 52/578 |
| 6,808,339 | B2 | 10/2004 | Peterson et al. | 405/262 |
| 6,927,183 | B1 | 8/2005 | Christen | 442/370 |
| 6,955,844 | B2 | 10/2005 | Tagge et al. | 428/53 |
| 7,232,589 | B2 | 6/2007 | Christen | 427/350 |
| 7,700,505 | B2 * | 4/2010 | Leclercq et al. | 442/386 |
| 8,071,205 | B2 * | 12/2011 | Tsuchiya et al. | 428/297.4 |
| 8,511,043 | B2 | 8/2013 | Fyfe | 52/834 |

* cited by examiner

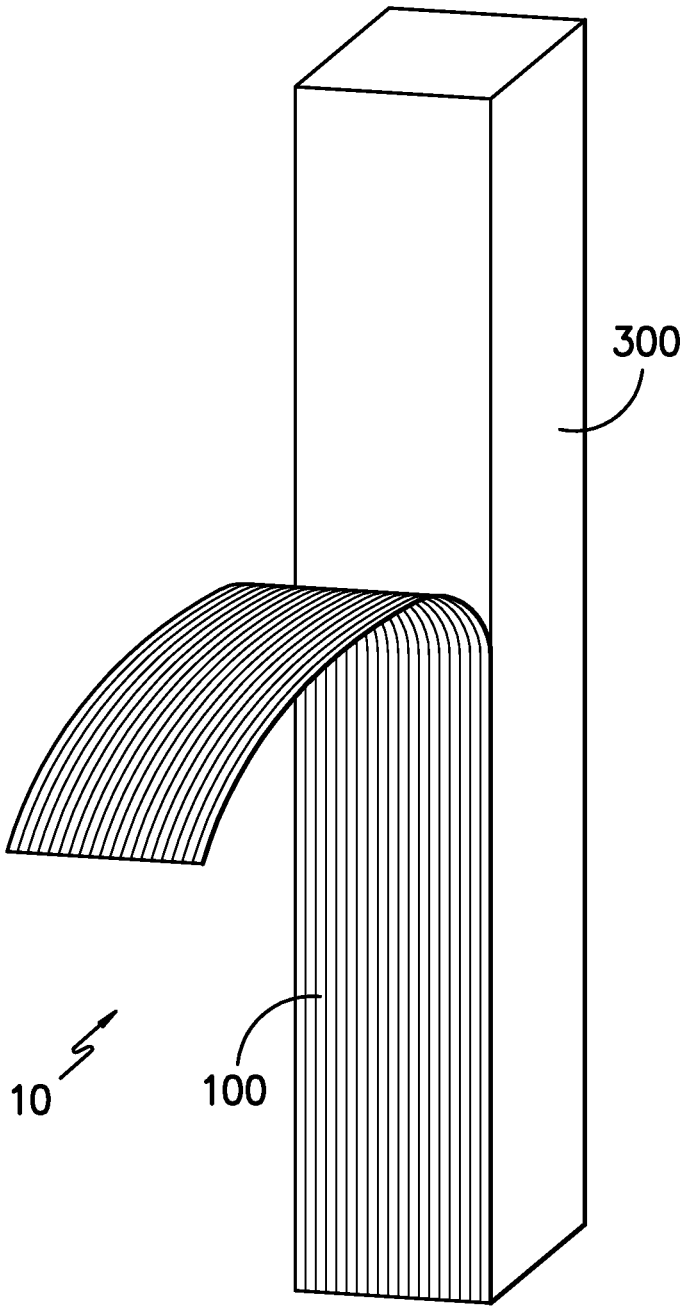
FIG. —1—

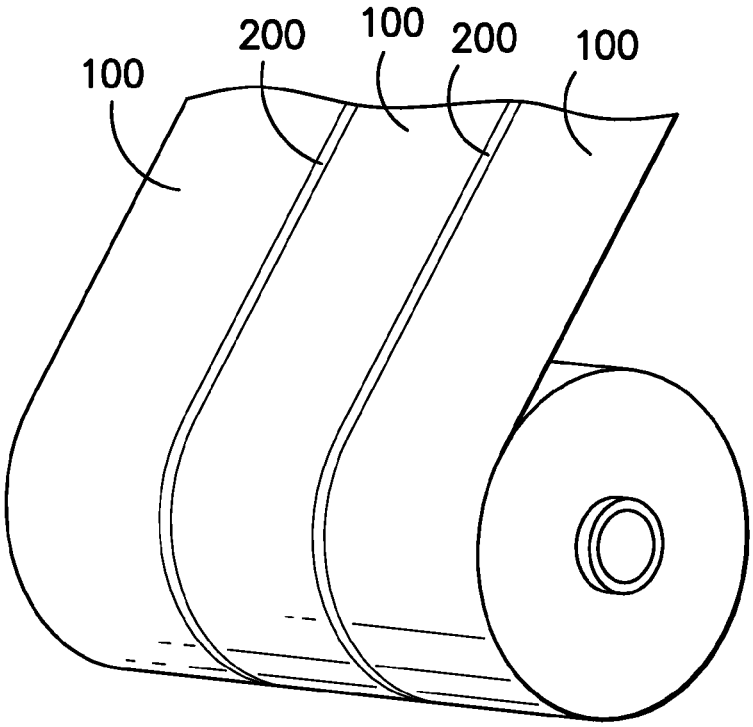
FIG. –2–
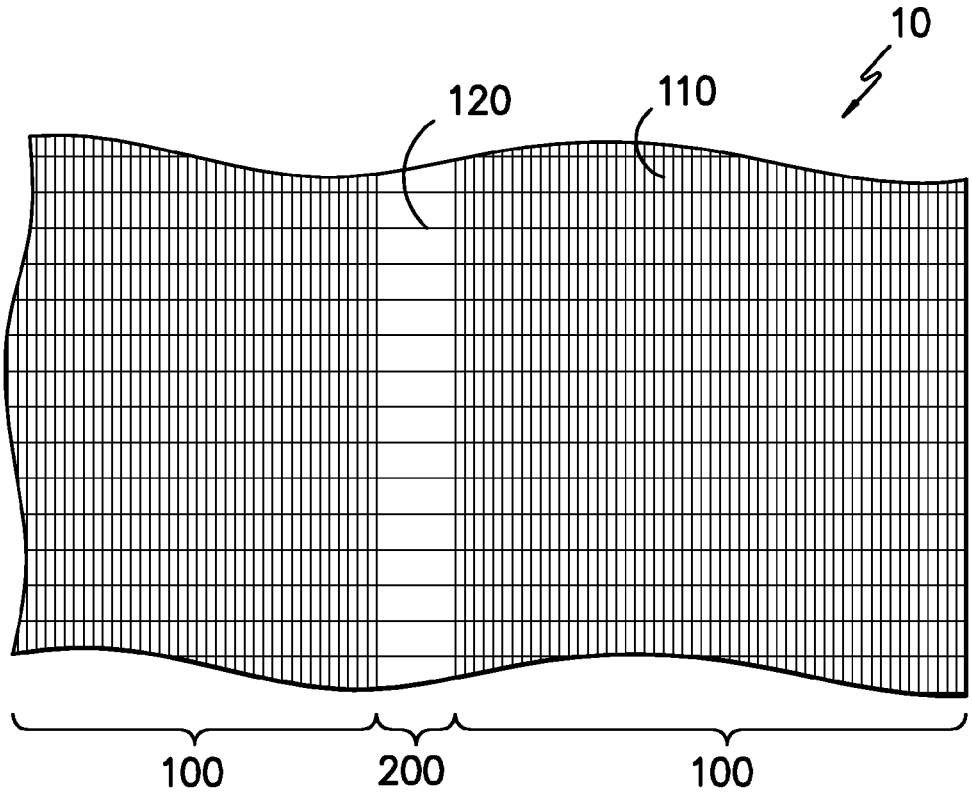
FIG. –3–

METHOD OF STRENGTHENING EXISTING STRUCTURES USING STRENGTHENING FABRIC HAVING SLITTING ZONES

RELATED APPLICATIONS

This application claims priority to U.S. Provisional Patent Application 61/730,540 filed on Nov. 28, 2012, which is herein incorporated by reference in its entirety.

TECHNICAL FIELD

The present disclosure relates generally to a method of strengthening existing concrete structures, masonry structures, timber structures, steel structures, and other construction materials using a strengthening fabric having slitting zones.

BACKGROUND

Composite reinforcement materials, specifically fiber reinforced polymers (FRP), have been used to strengthen existing concrete and masonry structures. FRP are strong, lightweight, highly durable, and can be easily installed in areas of limited access. These fiber reinforced polymers typically contain a glass or carbon fiber textile that is embedded in a matrix such as binder resin.

Wet lay-up FRP strengthening systems are simple to use and contractors have embraced the concept. Unidirectional or multi-directional carbon, glass, and aramid fabrics are most commonly used in the construction industry for strengthening concrete, masonry, and other types of structures. These fabrics made from tows or rovings are typically delivered to the job sites on rolls. The most common roll width appears to be 24"-wide, but other roll widths are also available. The fabrics are applied to beams, slabs, columns, walls, and other members comprising the load-carrying system of buildings, bridges, etc.

Applications of wet lay-up FRP strengthening systems for strengthening structures are usually classified as bond-critical where bond of the FRP to the substrate is required for proper performance or contact-critical where only intimate contact is required for proper performance, In general, the wet lay-up FRP strengthening systems are installed using most or all of the following sequence of steps: 1) repair of the substrate, 2) surface preparation of the substrate, 3) impregnation of the first layer of fabric with resin and placement on the substrate, 4) application of additional layers, if required, and 5) application of protection materials, if required.

The unidirectional reinforcing fabrics are supplied to the job sites in standard roll widths which in many cases are wider than required for the project. Many projects require plies of a specific width and length (like 3" wide plies for reinforcing the stems of some types of precast double-tee beams) which may be narrower than the standard roll width. For example, if the fabrics are delivered on 24"-wide rolls and the project required 8"-wide plies of reinforcement for the bottom of an 8"-wide beam the Contractor would have to slit the 24"-wide roll into three 8"-wide plies. Narrower plies, like 6" may be required to distribute the fabric across a wide slab. Slitting a wide unidirectional fabric into narrower plies can be accomplished in the field, but leaves the slit edges free to fray, fuzz, and break away and compromise the structural properties of the fabric. The slit edges are quite messy to work with. In addition, it is time consuming to measure out the desired width over a long length of the fabric at the jobsite. Therefore, there is a need for a reinforcing fabric that is easily slittable without damaging the reinforcing fibers and a need to easily and reliably determine the length of fabric required.

The unidirectional reinforcing fabrics are supplied to the job sites in standard roll lengths which in many cases are much longer than required for the member that is being strengthened. Most members that are being strengthened require plies of a specific length, depending on the geometry of the existing member and the strengthening details. Contractors would typically unroll the fabric, measure and cut the fabric to the required length.

BRIEF SUMMARY

Disclosed is a method of strengthening existing structures containing the following steps. An existing structure made of concrete, steel, timber, masonry to be reinforced and a reinforcing sheet are provided, where the reinforcing sheet contains an alternating arrangement of reinforcement zones and slitting zones. The reinforcement zones contain unidirectional strengthening fibers in the warp direction of the reinforcement sheet and the slitting zones have an absence of strengthening fibers. The reinforcement sheet is slit through the slitting zones and the reinforcement zones are adhered to the existing structure.

BRIEF DESCRIPTION OF THE FIGURES

An embodiment of the present invention will now be described by way of example, with reference to the accompanying drawings.

FIG. 1 is a view of an existing structure having applied one embodiment of the reinforcing zone from a reinforcing sheet.

FIG. 2 is a view of one embodiment of a reinforcing sheet in roll form.

FIG. 3 is an enlarged view of a one embodiment of the reinforcing sheet.

DETAILED DESCRIPTION

FIG. 1 shows a reinforcing zone 100 of a reinforcing sheet 10 being applied to an existing concrete structure, masonry structure, timber structure, steel structure, or other construction material 300 (herein referred to as existing structure 300) requiring additional reinforcement. The reinforcing sheet 10 may be applied or used on any suitable part of any suitable structural members including, but not limited to beams, joists, girders, stringers, slabs, decks, floors, columns, piers, piles, walls, diaphragms, collectors, pipes, tanks, silos, etc.

In one embodiment, the structure 300 is an existing concrete structure 300. This includes, but is not limited to, concrete slabs, beams, joists, pillars, and columns. Concrete is a composite construction material composed primarily of aggregate, cement, and water. There are many formulations that have varied properties. The aggregate is generally coarse gravel or crushed rocks such as limestone or granite, along with a fine aggregate such as sand. The cement, commonly Portland cement and other cementitious materials such as fly ash and slag cement serve as a binder for the aggregate. Various chemical admixtures are also added to achieve varied properties. Water is then mixed with this dry composite which enables it to be shaped (typically poured) and then solidified and hardened through a chemical process known as hydration. The water reacts with the cement which bonds the other components together creating a robust stone-like material. Concrete has relatively high compressive strength but much lower tensile strength. For this reason it is usually reinforced with materials that are strong in tension (often steel rebar).

The existing concrete structure 300 typically contains reinforcements within the structure in the form of steel or iron reinforcement bars ("rebars"), reinforcement grids, plates or fibers.

The reinforcing sheet may also be used to increase the strength, stiffness, or ductility of structural members made of masonry, steel, timber or combinations of those materials when they are designed for composite-action. In the case of steel members, the reinforcing sheets may be used to increase the tensile capacity or stiffness of tubes, pipes, channels, plates, wide-flange section, or built-up sections. In the case of masonry members, the reinforcing sheets may be adhered directly to the bricks, concrete masonry units, hollow clay tiles or other masonry materials to provide flexural, shear, and axial strength. In the case of timber structures, the reinforcing sheets may be adhered or wrapped around the timber or glue-laminated members to increase flexural, shear or axial capacity. They may also be used to increase the member's stiffness.

To strengthen and increase the load bearing capacity of existing structures 300 when subjected to flexural loading (e.g. bottoms of beams, slabs) or compressive loading (e.g columns), the aforementioned reinforcing sheets may be applied to the surfaces of the existing structures 300 at strategic locations where additional tension strength is required. In the case of a beam or slab where additional flexural strength is required, the reinforcing sheets would be applied to the surfaces where the tensile force are highest, typically on the bottom surface between the supporting structure and on the top over the supporting structure.

In one embodiment, approximately 10-100% of the surface area of at least one face of the existing structure 300 is covered in the reinforcement zones of the reinforcing sheet. In previously available strengthening solutions, workers had to cut unidirectional carbon fiber sheets to the correct width at the job site and this cutting resulted in a portion of the carbon fibers being cut. These cut carbon fibers reduced the strength of the reinforcement.

FIG. 2 illustrates one embodiment of reinforcing sheet 10 containing reinforcement zones 100 and slitting zones 200 in roll form. The reinforcing sheet 10 contains a warp direction (machine direction or direction along the length of the roll) and a weft direction (cross-machine direction, across the width of the roll, and perpendicular to the warp direction). The reinforcing zones 100 contain unidirectional strengthening fibers 110. The unidirectional strengthening fibers 110 are in the warp direction in the reinforcement zones 100 but not in the slitting zones 200. The reinforcing sheet 10 also has weft fibers (not shown in FIG. 2) that run the weft direction of the reinforcing sheet 10. The weft yarns are used to stabilize the fabric and keep the warp yarns parallel to each other. FIG. 3 illustrates an enlarged view of the reinforcing sheet 10 showing the reinforcing zones 100, slitting zone 200, unidirectional strengthening fibers 110, and the weft fibers 120.

In one embodiment, the reinforcing zones have a width of 2", 4", 6", 12" or other width that may or may not correlated to standard sizes of different structural members. The widths of the reinforcing zones may be custom made per the structure to be reinforced, come in standard widths for standard jobs, or may vary in width across the roll (this would enable one roll of reinforcing sheet material to contain multiple widths of reinforcing zones 100). In one embodiment, the edge of the reinforcing zones 100 (where the reinforcing zones 100 meet the slitting zones 200) are highlighted in some way. One way would be to have a different colored fiber, other stitching pattern (such as a leno weave pattern where the rest of the zone contains plain weave patterns), or any other suitable indicator. These indicators would enable installers to easily differentiate where to cut the reinforcing sheet 10 and to keep the reinforcing fibers 110 in place to minimize cutting the reinforcing fibers 110.

The number of reinforcing zones 100 and slitting zones 200 across the width of the reinforcing sheet 10 depend on the width of the roll, the reinforcing zones 100, and the slitting zones 200. Preferably, the width of the reinforcing zones is between about 2 and 36 inches, more preferably between about 4 and 24 inches. The slitting zones preferably have a width of between about 2 and 20 millimeters, more preferably between about 4 and 8 millimeters.

In one embodiment, the slitting zones have a width of significantly more than 8 millimeters, up to several inches or feet and may serve as a spacer zone. In this embodiment, the entire reinforcing sheet would be placed on the existing structure with the spacer zones not containing reinforcement fibers by serving to hold the space between the reinforcement zones. This may also provide regularly-spaced breathability zones which allow for the transport of air and water vapor. Many FRP strengthening systems that completely encapsulate or cover the concrete surface trap moisture and air vapor such that when temperatures rise and the trapped vapor expands, the FRP may delaminate from the surface. In addition, if moisture is not allowed to escape from the surface and it freezes, delaminations may also result. On some prior projects, the reinforcing sheets were slit in the field and spaced apart to allow for moisture vapor transmission, so a fabric that includes built-in breathability zones will be desirable.

The reinforcing zones 100 comprise reinforcing fibers 110. By the term "reinforcing fiber" herein used is meant a substantially continuous fiber used for a fibrous reinforcing material. For example, there can be mentioned a carbon fiber, a glass fiber, an aramid fiber, a basalt fiber, a silicon carbide fiber, a boron fiber, a metal fiber, a polybenzothiazole fiber, a polybenzoxazole fiber and an alumina fiber. The reinforcing filament includes not only a multifilament but also a fiber yarn which is substantially continuous, although constituent single fibers per se are not continuous, such as a spun yarn. An untwisted continuous filament is especially preferably used because the strength and elastic modulus are increased when the fiber is formed into a composite material. "Fiber", in this application, is defined to include a monofilament elongated body, a multifilament elongated body, ribbon, strip, fiber, tape, and the like. In one embodiment, the reinforcing fibers 110 are formed from the list including but are not limited to synthetic polymers (e.g., polyolefins), carbon, nylon, aramid, and glass. Synthetic polymers include polyethylene (including high density polyethylene, low density polyethylene, and ultra-high molecular weight polyethylene), polypropylene, polyoxymethylene, poly(vinylidine fluoride), poly(methyl pentene), poly(ethylene-chlorotrifluoroethylene), poly(vinyl fluoride), poly(ethylene oxide), poly(ethylene terephthalate), poly(butylene terephthalate), polyamide, polybutene, and thermotropic liquid crystal polymers. In one embodiment, the fibers are preferably carbon fibers Carbon fibers are preferred for their high strength per unit of thickness or weight, durability, corrosion resistance, strength, low weight, easy installation, and low impact on the existing dimensions of a structure. Preferably the carbon fibers have a basis weight of between about 300-600 gram/$m^2$ and a tow size of between about 12K-24K.

The reinforcing sheet may be formed from any suitable textile, including but not limited to woven, knit, nonwoven, unidirectional, and scrim textiles. Preferably, the amount of non-reinforcing fibers (weft fibers and any other non-reinforcing fibers) is kept to a minimum such that the amount of reinforcing fibers in the reinforcing sheet is maximized in terms of weight and volume.

The weft fibers may be any suitable fiber. In one embodiment, the weft fibers are reinforcing fibers. This embodiment may be preferred when strengthening is needed in the cross-machine direction (weft) as well as the machine direction (warp).

Preferably, the weft fibers are binder fibers. The binder fibers serve to melt or partially melt at a low temperature to secure the reinforcement sheet 10 and the reinforcement fibers 110 in place. The binder fibers may be any suitable binder material and may be staple or continuous fibers. Suitable thermoplastic binder materials include, but are not limited to, polyesters (e.g., polyethylene terephthalate (PET) or glycol-modified PET (PETG)), polyamides (e.g., nylon 6 or nylon 6,6), polyethylenes (e.g., high density polyethylene (HDPE) or linear low density polyethylene (LLDPE)), polypropylenes, polylactic acid, poly(1,4-cyclohexanedimethylene terephthalate) (PCT), and combinations thereof. Suitable binder fibers 120 also include, but are not limited to, bicomponent binder fibers (e.g., bicomponent binder fibers comprising a thermoplastic sheath) and thermoplastic binder fibers having a relatively low melt flow rate. In another embodiment, the binder fibers are low melt fiberglass which are fiberglass fibers coating with a low melt thermoplastic. Suitable bicomponent fibers include bicomponent, sheath-core fibers in which the sheaths have a lower melting point than the cores of the fibers. For example, the bicomponent, sheath-core fiber can have a polyethylene sheath (e.g., a high density polyethylene sheath) and a polypropylene or polyester core. Other suitable bicomponent fibers include fibers having a PET copolymer sheath and a PET core, a PCT sheath and polypropylene core, a PCT sheath and a PET core, a PETG sheath and a PET core, a HDPE sheath and a PET core, a HDPE sheath and a polypropylene core, a LLDPE sheath and a PET core, a polypropylene sheath and a PET core, or a nylon 6 sheath and a nylon 6,6 core.

In another embodiment, the weft fibers may contain tracer fibers of an easily visible color at regular intervals, like 12" or 24", etc. that can assist the contractor in measuring the length of fabric needed for the application. These tracer fibers may or may not be binder fibers. The binder fiber may also contain additional functionality such as being ultraviolet or florescent.

In another embodiment, the reinforcement sheet contains no slitting zones and is essentially one large reinforcement zone containing transverse tracer fibers spaced at regular intervals, like 12 inches, for instance. This would enable easier measuring of the reinforcement sheet.

In one embodiment, the reinforcing sheet 10 contains extra binder fibers (or other fibers suitable for use as a weft fiber) along the edges of the reinforcing zones 100 in the warp direction or within the reinforcing zones 100. These extra binder fibers that run in the warp direction of the reinforcing sheet 10 serve to keep the reinforcing fibers 110 in place in the reinforcing zones 100 and out of the slitting zones 200. In one embodiment, the reinforcing sheet 10 contains a pair of binder fibers on each edge of the reinforcing zones 100, with the pairs of extra binder fibers being in a leno weave pattern. In a leno weave, the yarns are arranged in pairs with one twisted around the other between weft yarns. This helps securely hold the fibers in the correct position.

In one embodiment, the reinforcing sheet is a woven textile with the reinforcing fibers in the warp direction and the weft fibers in the weft direction. Woven fabrics are preferred as the warp fibers are well aligned in the warp direction and held in place. Some woven textiles include plain, satin, twill, basket-weave, poplin, jacquard, and crepe weave textiles. In one embodiment, the woven textile is a plain weave textile. In another embodiment, the woven textile is a leno weave. In one embodiment, the woven textile contains two or more weave pattern across the width of the reinforcing sheet 10, such as a plain weave within the reinforcing zones 100 and a leno weave between the slitting zones 200 and the reinforcing zones 100.

In another embodiment, the reinforcing sheet is a knit textile, for example a circular knit, reverse plaited circular knit, double knit, single jersey knit, two-end fleece knit, three-end fleece knit, terry knit or double loop knit, weft inserted warp knit, warp knit, and warp knit with or without a micro-denier face. Knit textiles may be preferred when a conformable fabric is required to reinforce a complex three-dimensional existing structure (such as architectural structure repair and strengthening.

In another embodiment, the reinforcing sheet is a multi-axial textile, such as a tri-axial fabric (knit, woven, or non-woven). In another embodiment, the textile is a bias fabric. In another embodiment, the textile is a non-woven. The term non-woven refers to structures incorporating a mass of yarns that are entangled and/or heat fused so as to provide a coordinated structure with a degree of internal coherency. Non-woven fabrics for use as the textile may be formed from many processes such as for example, meltspun processes, hydroentangling processes, mechanically entangled processes, stitch-bonded and the like.

In another embodiment, the textile is a unidirectional textile and may have overlapping yarns or may have gaps between the yarns. The unidirectional textile may contain the unidirectional reinforcing fibers 110 and some additional fibers such as binder fibers to hold the reinforcing fibers 110 in place and parallel.

Referring back to FIG. 3, there are also slitting zones 200. The slitting zones have an absence of reinforcing fibers 110. This absence make cutting a straight line along the length of the reinforcing sheet 10 easier and minimizes or prevents cutting the reinforcing fibers when cutting the sheet 10. The slitting zones 200, in one embodiment only contain weft yarns. In other embodiments, the slitting zones 200 contain warp yarns that are not reinforcing fibers. The sheet 10 may be slit in any suitable manner in the slitting zones 200. This includes, but is not limited to slitting or cutting with a scissor, a knife, a blade, ultrasonic slitting, and a hot knife. In another embodiment, the weft fibers 120 are tailored such the slitting zones 200 may be easily torn by hand. This may be preferred as it reduces possible cutting accidents and injuries, speeds installation, and reduces the tooling needed for the job. "Easy-rip", or hand tearable fabrics will typically use a polyester weft yarn. In one embodiment, the reinforcement fabric comes in standard widths and basis weights (gram/$m^2$) and the fabric is able to be folded along the slitting zone edge to double the reinforcement in a case where a job demands additional reinforcement.

The reinforcement zones 100 of the reinforcing sheet 10 may be applied to the existing structure forming a strengthened existing structure in any suitable manner. Adhering the reinforcement zone to the preformed concrete structure involves the following steps as prescribed by ACI 440 guide for externally bonded FRP systems—a) surface preparation (grinding the concrete surface), c) filling the cracks and voids in the structure c) priming the concrete structure (epoxy primer) and putty application, d) saturating the reinforcing fibers with a thermoset resin (epoxy) and bonding it to the primed concrete surface, e) allowing the resin to cross-link and cure.

The sheet 10 may be applied to the structure 300 using resin that is applied by hand using brushes, rollers, or similar tools or applied by impregnating using a machine where the fabric is submerged in a resin bath and excess resin squeezed out.

In one embodiment, the sheet 10 is applied to the existing structure by an adhesive. In one embodiment, the adhesive is an inorganic binder, also referred to as a grout or mortar. In one embodiment, the inorganic binder contains an inorganic matrix made with sand mixed with hydraulic cements such as Ordinary Portland Cement (OPC) or acid base cements such as magnesium phosphates, aluminosilicates and phosphosilicates. Admixtures such as setting accelerators, retarders, and super plasticizers are added to these grouts and mortar mixes to tailor their setting and curing times and strength. To effectively transfer the stresses from the concrete to the reinforcement, these inorganic binders should develop sufficient early compressive strength equal to or greater than the concrete compressive strength in a short period. Additionally, to maintain the composite action these inorganic binders should be able to achieve intimate contact with the concrete structural member and preferably are low- or non-shrinking to preclude debonding from either the concrete substrate or the sheet 10. The inorganic binder is also preferably incombustible. The inorganic binder may be, for example, cementitious material high temperature epoxy grouts containing inorganic aggregates, pozzolanic minerals, polysialate geopolymers, and phosphate based chemically bonded ceramics. Preferably, the inorganic binder 300 comprises a cementitious material. Cementitious material is preferred for its incombustibility, fire resistance, bonding ability to concrete, and cost.

In one embodiment, the binder is not inorganic but is an organic material having a very high $T_g$. Several alternative organic resins can be considered, such as anhydride-cured epoxies, cyanate ester, and phenolic resins. Additional inorganic resins might also be used, such as metal matrices, ceramics, cementitious mixtures, and geopolymers. In addition, for pultruded members, high temperature thermoplastics such as carbon pitch or engineered resins could be used. In another embodiment, the binder may be an epoxy, polyurethane, acrylic, polyester, vinylester, or furan. Any polymer resin having suitable viscosity to enable application to an underlying substrate and having reactivity characteristics such that it will not react with the underlying substrate or fiber reinforcement may be able to be used as a binder. The binder used should also have a high tensile strength, low creep and good adhesion properties.

If an adhesive is used to attach the reinforcing sheet 10 to the existing structure 300, the adhesive may be applied by a coating or any other method to the sheet 10 and/or the existing structure 300. In another embodiment, the adhesive is introduced as a separate free-standing layer that is sandwiched between the sheet 10 and the existing structure 300. Pressure is then applied to the sheet 10, existing structure 300, and adhesive to insure good contact and adhesive properties.

In one embodiment, the method comprises the following steps. First, prepare the surfaces for bonding. Second, slit the fabric to the required width along the slitting zones. Third, using the tracer yarns in the transverse direction, approximately roll out the required length and cut fabric to the desired length. Forth, bond fabric to concrete.

In another embodiment, the strengthened existing structure may also contain an insulation layer at least partially (preferably fully) covering the reinforcing fibers 110 of the reinforcing sheet 10. The insulation layer may be optionally added for added fire and temperature protection for the strengthened concrete member. The insulation layer may be any suitable insulation layer formed of any suitable material, weight, and thickness. In one embodiment, the insulation layer preferably keeps the interface temperature (temperature taken at the outer surface of the existing structure below 250° C. for at least 120 minutes (more preferably at least 170 minutes, more preferably at least 240 minutes) while the front side of the insulation layer (side of the insulation layer facing away from the concrete structural member) is held at 1100° C. Preferably, the insulation layer is self-supporting, durable to handling and impact, and resistive to environment.

In one embodiment, the insulation layer contains a majority of ceramic fibers by weight and a minority of organic binding agents by weight such as insulation layers which can be purchased commercially from several vendors such as Morgan Thermal Ceramics, Unifrax Corporation, and Ceramaterials.

In another embodiment, a nanoclay composite insulation board may be used as the insulation layer. The nanoclay composite preferably is a three-dimensional network comprising nanoclay and a cross-linked gel that can bethermoreversible infused in a three dimensional fibrous blanket or blended with chopped fiber. The gel is preferably non-covalently cross-linked and the materials form a three-dimensional network which contains three-dimensional microscopic cells, where the microscopic cells have an aspect ratio from about 0.2 to about 5. The fiber blanket or chopped fibers consist of high temperature, refractory materials, such as ceramics, silica glass, mineral wool, or basalt. These nanoclay composites are eco-friendly, low density, and fire-resistant composite materials that exhibit a homogeneous microscopic porous structure and desirable physical characteristics. More details about the composition, performance, and method of making the nanoclay composite may be found in U.S. patent application Ser. No. 13/484,322, filed on May 31, 2012 which is incorporated herein in its entirety.

In another embodiment, the insulation layer may contain an intumescent paint which swells to at least several times its original thickness when exposed to the heat of a fire forming an insulating layer of carbonaceous char, such as CLAD® TF from Albi Manufacturing. In another embodiment, the insulation layer may contain a refractory fiber blanket, such as the flexible ceramic insulation from Morgan Thermal Ceramics. In another embodiment, the insulation layer may contain a semi rigid board made from molten volcanic rock which is spun into fine threads (rockwool), impregnated with a binder and compressed to form a durable structure, such as DRI-CLAD® board from Albi Manufacturing. In another embodiment, the insulation layer may contain a cementitious fireproofing insulation material that consists of one or all of cement, vermiculite, gypsum, fibers, light weight aggregates, etc., such as PYROCRETE® 241 from Carboline or MONOKOTE® Z146 from Grace. In another embodiment, the insulation layer may contain an aerogel insulation blanket coated with a layer of cementitious fireproofing material. An example of such aerogel insulation is PYROGEL® XT from Aspen Aerogel. In another embodiment, the insulation layer may contain a light weight cement based composite which contains a cementitious matrix such as Portland cement and light-weight, porous aggregates which create structural porosity and increase insulation value. Such aggregates may include hollow glass spheres such as 3M Glass Bubbles K15. In another embodiment, the insulation layer may contain gypsum board. In another embodiment, an insulation board is coated with an intumescent paint on the outside surface. In another embodiment, an intumescent coating may be applied to a fibrous, open blanket. The coating gains additional depth in the blanket when consolidated to its final thickness, effectively creating a fiber reinforced intumescent composite on the surface of the fiber board. Alternatively, an intumescent coating may be applied to fibers directly during the process to form staple fiber into a blanket or board assembly. In another embodiment, fire retarding agents can be applied, such as in a powder form into a high temperature insulation blanket, such as a flexible ceramic blanket from Morgan Thermal Ceramics.

The insulation layer could be a combination of any of the above listed categories of insulation materials or any other suitable insulating materials. The detailed thickness and sequences of construction of different insulations will be based on considerations such as cost, durability, installation as well as desired duration of protection from fire. The thickness of the insulation layer is typically between about ¼" and 3" (0.635 and 7.62 cm).

In one embodiment, the insulation layer is attached to the outer surface of the existing structure over the reinforcing fibers such that the protection remains intact during a fire event. Various adhesives as well as mechanical fasteners may be used to ensure adequate bond. The same adhesive and mechanical fasteners described for use in adhering the reinforcing sheet 10 to the existing structure may be used.

Example

One embodiment of the reinforcing sheet was formed having reinforcing zones and slitting zones. The sheet had a total width of approximately 24 inches and contained four reinforcing zones, each having a width of approximately 5.75 inches and three slitting zones, each having a width of approximately 0.25 inches. The reinforcing sheet was a unidirectional fabric having warp yarns and weft yarns. The warp yarns were the reinforcing fibers which were 12K carbon fiber tows. The weft yarns were binder fibers of low melt fiberglass fibers, believed to be fiberglass fibers coated with a low melt thermoplastic. The reinforcing zones had an areal weight of 340 g/m$^2$. The reinforcing sheet also contained a pair of extra binding fibers in the warp direction where the reinforcing zones met the slitting zones with the pair of binding fibers being in a leno weave construction. After the sheet was formed, heat was applied to partially melt the binder fibers and secure the reinforcing fibers in place and parallel.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of strengthening existing structures comprising:

providing an existing structure made of concrete, steel, timber, masonry to be reinforced;

providing a reinforcing sheet, wherein the reinforcing sheet comprises a warp direction and a weft direction perpendicular to the warp direction, wherein the reinforcing sheet comprises a plurality of weft fibers in the weft direction and an alternating pattern of reinforcement zones and slitting zones across the reinforcing sheet in the weft direction, the reinforcement zones having a reinforcement width in the weft direction of the reinforcing sheet and the slitting zones having a slitting width in the weft direction of the reinforcing sheet, wherein the reinforcement zones comprise unidirectional strengthening fibers in the warp direction of the reinforcement sheet and the slitting zones have an absence of strengthening fibers in the warp direction of the reinforcing sheet, and wherein the reinforcement widths of the reinforcement zones vary across the width of the reinforcement sheet;

slitting the reinforcement sheet in the warp direction in at least one of the slitting zones;

adhering the reinforcing sheet comprising at least one reinforcement zone to the existing structure.

2. The method of claim 1, wherein the existing structure forms part of a structural member selected from the group consisting of beams, joists, girders, stringers, slabs, decks, floors, columns, piers, piles, walls, diaphragms, collectors, pipes, tanks, silos.

3. The method of claim 1, wherein the unidirectional strengthening fibers comprise carbon fibers.

4. The method of claim 1, wherein adhering the first reinforcement zone to the existing structure comprises complying adhesive or mortar to the existing structure or reinforcing sheets and adhering the reinforcing sheets to the existing structure.

5. The method of claim 1, wherein the weft fibers are binder fibers.

6. The method of claim 1, wherein the slitting zones are hand tearable.

7. The method of claim 1, wherein the reinforcing fabric further comprises tracer fibers in the weft direction.

8. The method of claim 1, wherein the reinforcement sheet comprises extra fibers in the warp direction of the sheet at the interface between the reinforcement zones and the slitting zones.

9. The method of claim 8, wherein the extra fibers are colored.

10. The method of claim 1, wherein the reinforcement sheet comprises pairs of binder fibers in the warp direction at the interface between the reinforcement zones and the slitting zones, wherein the pairs of binder fibers are in a leno weave construction.

11. The method of claim 1, wherein further comprising placing additional reinforcement zones at least partially overlapping the reinforcement zones adhered to the existing structure.

12. The method of claim 1, wherein the existing structure has a width and wherein the width in the weft direction of the reinforcing zones is approximately equal to the width of the existing structure.

13. The method of claim 1, further comprising:

adhering an insulation layer to the existing structure at least partially covering the reinforcing zones of the reinforcing sheet forming an insulated strengthened existing structure.

14. The method of claim 13, wherein the insulated strengthened existing structure passes the ASTM E-119 test.

* * * * *